United States Patent [19]

Entrekin et al.

[11] Patent Number: 4,838,340

[45] Date of Patent: Jun. 13, 1989

[54] CONTINUOUS CASTING OF FINE GRAIN INGOTS

[75] Inventors: Charles H. Entrekin, Coatesville; Howard R. Harker, Malvern, both of Pa.

[73] Assignee: Axel Johnson Metals, Inc., Lionville, Pa.

[21] Appl. No.: 257,227

[22] Filed: Oct. 13, 1988

[51] Int. Cl.[4] ..... B22D 11/22

[52] U.S. Cl. ..... 164/455; 164/154; 164/469; 164/505; 164/508

[58] Field of Search ..... 164/451, 452, 453, 455, 164/150, 154, 155, 505, 506, 507, 466, 469, 494, 470, 122, 488, 489, 437, 438, 439, 133, 337, 508

[56] References Cited

U.S. PATENT DOCUMENTS

| | | | |
|---|---|---|---|
| 3,343,828 | 9/1967 | Hunt | 266/208 |
| 4,261,412 | 4/1981 | Soykan et al. | 164/469 |
| 4,558,729 | 12/1985 | Hunt | 164/469 |
| 4,583,580 | 4/1986 | Hunt | 164/469 |
| 4,641,704 | 2/1987 | Lowe | 164/474 |
| 4,681,787 | 7/1987 | Hunt | 148/425 |
| 4,690,875 | 9/1987 | Hunt | 428/577 |
| 4,730,661 | 3/1988 | Stephan | 164/506 |
| 4,750,542 | 6/1988 | Harker et al. | 164/506 |

*Primary Examiner*—Richard K. Seidel

*Attorney, Agent, or Firm*—Brumbaugh, Graves, Donohue & Raymond

[57] ABSTRACT

In the representative embodiment described in the specification, continuous casting of fine-grain ingots is effected by supplying molten metal to a mold in which the metal is solidified and an ingot is withdrawn downwardly and controlling the temperature in the central region of the molten metal above the ingot at a level at which small crystallites of metal are formed, but large quantities of solid material are not formed. The desired temperature level may be maintained by visual observation of the surface of the metal or pyrometric detection of the temperature of the surface and control of a directional energy input device such as an electron beam gun or a plasma torch to supply sufficient energy to maintain the desired temperature level. The typical apparatus described in the specification includes a cold hearth containing a pool of molten metal which is supplied to the mold and energy input devices, which may be electron beam guns or plasma torches, for melting the material in the hearth and maintaining the temperature of the molten material in the hearth and the mold at the desired levels, along with temperature detectors for detecting the temperature of the molten metal in the hearth and the mold, and a control unit for controlling the energy input devices for the hearth and the mold.

25 Claims, 1 Drawing Sheet

CONTINUOUS CASTING OF FINE GRAIN INGOTS

BACKGROUND OF THE INVENTION

This invention relates to casting of fine-grain metal ingots and, more particularly, to a new and improved method and apparatus for continuous casting of fine-grain ingots and to the ingots produced thereby.

For certain applications, such as components of aircraft engines and the like, it is important to obtain an ingot of metal alloy material which has a substantially uniform fine-grain structure. Efforts have been made in the past to produce fine-grain alloy ingots by various techniques. In the patents to Hunt, U.S. Pat. Nos. 4,583,580 and 4,681,787, for example, a continuous casting method is described in which the alloy to be continuously cast is heated in a cold hearth electron beam furnace and the temperature of the alloy in the hearth is controlled so as to maintain a solids content of about 15% to 40% so that the molten mixture poured from the hearth to the casting mold has a high content of solid material. As a result, the molten material in the mold has a substantially thixotropic region with a solids content of at least 50%. To maintain this condition, heat energy is applied to the material in the mold only in the region adjacent to the side wall of the mold to the extent necessary to assure the integrity of the side wall of the ingot.

To prevent hot tears in the side walls of an ingot being cast continuously, the Lowe U.S. Pat. No. 4,641,704 discloses periodic pouring of successive equal volume quantities of molten material into the mold spaced by cooling periods and intermittent lowering of the ingot in the mold following each cooling period.

A different approach described, for example, in the Hunt U.S. Pat. Nos. 4,558,729 and 4,690,875 and the Soykan et al. U.S. Pat. No. 4,261,412, utilized a mold structure into which molten drops of the ingot material fall and solidify individually with a fine-grain structure. The mold is maintained at a temperature which is below the solidus temperature of the ingot material, but above a temperature at which metallurgical bonding of the successive molten drops can occur, thereby producing an ingot without altering the size and distribution of the grains in the solidified metal drops.

Such techniques are not only complicated and difficult to execute, but also place limitations on the size and shape and properties of the resulting ingot.

SUMMARY OF THE INVENTION

Accordingly, it is an object of the present invention to provide a new and improved continuous casting method and apparatus which overcomes the disadvantages of the prior art.

Another object of the invention is to produce a new and improved fine-grain ingot prepared by continuous casting.

A further object of the invention is to provide a continuous casting method by which the formation of an ingot and the resulting ingot grain structure can be carefully controlled.

These and other objects of the invention are attained by detecting and controlling the temperature of the exposed surface of the molten metal in a mold in which an ingot is being formed by continuous casting so as to maintain the temperature in the central region at a level at which a small number of crystallites are formed, but significant quantities of solid material are not formed in that region. This may be accomplished by maintaining the temperature approximately at or slightly below, such as between 0° C. and 20° C. below, and preferably between 0° C. and 10° C. below, the liquidus point of the metal. Preferably, to assure the necessary temperature condition in the mold, the molten metal being supplied to the mold is heated to a temperature substantially above, preferably 30° C. and more desirably 50° C. to 100° C. or more above, the liquidus temperature of the metal, and a directionally controllable energy source supplies energy to the surface of the molten metal at a rate sufficient to maintain the temperature in the central region at the desired level.

In a preferred arrangement for fine-grain casting of ingots, an energy source such as an electron beam gun or a plasma torch is arranged to direct energy selectively toward various portions of the surface of the molten metal in the mold and a temperature detecting device detects the temperature at the surface of the molten metal in the central region of the mold and controls the energy source so as to maintain that temperature at the desired level. In addition, another energy source, such as an electron beam gun or plasma torch, directed toward the surface of the molten metal being supplied to the mold is controlled by another temperature detecting device which detects the temperature of the molten metal being supplied to the mold so as to maintain that temperature at the desired level.

BRIEF DESCRIPTION OF THE DRAWING

Further objects and advantages of the invention will be apparent from a reading of the following description in conjunction with the accompanying drawing, in which.

DESCRIPTION OF PREFERRED EMBODIMENTS

Figure 1:
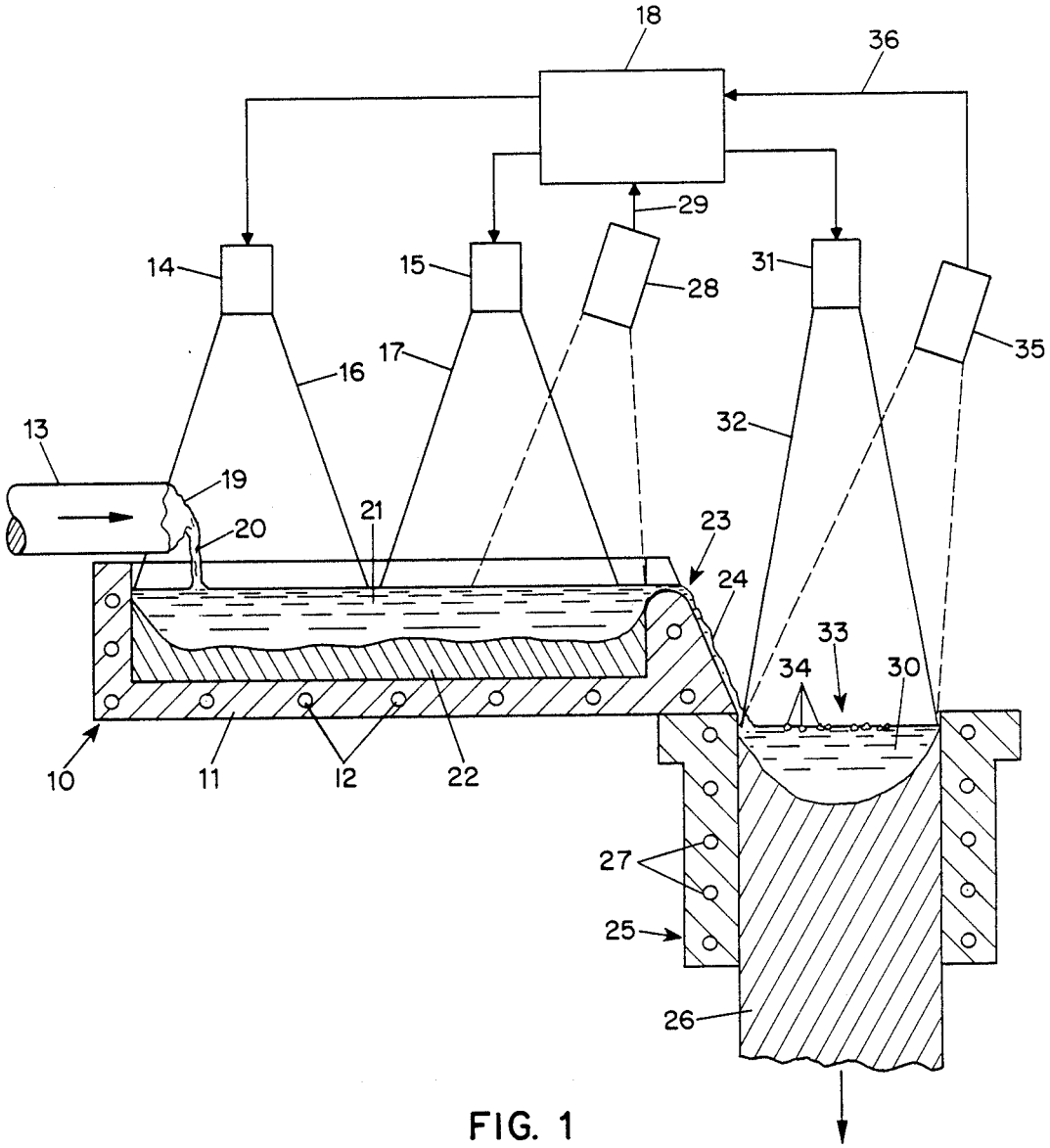
FIG. 1 is a schematic sectional view illustrating a representative embodiment of an arrangement for casting fine-grain ingots in accordance with the invention.

In order to obtain fine-grain cast ingots in accordance with the invention, it is important to control the temperature at the central region of the surface of the molten metal in the mold so that a few crystallites are formed, but significant quantities of solid material are not formed in that region. For this purpose, the surface of molten metal in the mold may be scanned visually, optically or electronically and the energy input to the metal at the surface of the mold is controlled so as to maintain the temperature of the central region of the surface at the necessary level, for example, by selective application of energy from a directionally controllable energy input device such as a plasma torch or an electron beam gun. The temperature of the peripheral portion of the surface of the molten metal in the mold should be maintained slightly above the liquidus point of the metal being molded.

The existence of the desired temperature condition in the central region can be detected visually by observing the formation of small crystallites at the surface of the molten material which appear like "silverfish" and the energy input is controlled so that only a small number of crystallites are observable. If the temperature exceeds the desired level, the crystallites will disappear and if the temperature drops below the desired level a significant quantity of solid material will appear in the central portion of the surface.

The temperature of the central region of the surface of the molten metal in the mold may also be monitored by means of a temperature detector such as a pyrometer providing a visual indication of the temperature of that region and the energy applied to that region by the controllable energy source may be controlled in accordance with the observed indications of the temperature detector. In this case, the temperature should be maintained between about 0° C. and 20° C., and preferably between 0° C. and 10° C., below the liquidus point of the metal.

Alternatively, automatic control of the energy supplied to the molten metal in the central region of the mold may be effected by providing an output signal from a temperature-detecting device such as a pyrometer and controlling the output of the directionally controllable energy source in accordance with differences between the detected temperature and a selected temperature at or slightly below the liquidus point of the metal. If desired, the pyrometer may be a scanning pyrometer providing a temperature profile of the entire surface of the molten metal in the mold so that the energy directed toward all parts of the surface may be controlled as desired, either automatically or based on visual observation of a representation of the temperature profile.

In this way, the desired temperature condition may be maintained in the central region regardless of the differing radiant energy loss conditions for large and small molds, molds of noncircular cross-section and molds providing multiple ingots.

In order to obtain the desired fine-grain ingot in accordance with the invention, the molten metal supplied to the mold should not contain any solid material. For this purpose, the molten metal, which may be supplied to the mold from a cold hearth in which it is heated by directionally controllable energy input devices such as electron beam guns or plasma torches, for example, is superheated to a level substantially above the liquidus point of the metal, such as at least 30° C., and preferably 50° C. to 100° C. or more, above that point. Maintenance of the required temperature level of the material being supplied to the mold is preferably monitored by a temperature detecting device such as a pyrometer and the energy supplied by a directionally controllable energy source such as an electron beam gun or plasma torch is controlled in accordance with the detected temperature so as to maintain the temperature of the molten metal at the desired level.

In the representative embodiment of the invention illustrated schematically in FIG. 1, a hearth 10 comprises a hearth bed 11 containing cooling pipes 12 through which water or another cooling liquid may be circulated. At the inlet end of the hearth, a bar 13 of metal alloy to be refined and cast into a fine-grain ingot is moved continuously toward the hearth in the usual manner as indicated by the arrow. Alternatively, the raw material supplied to the hearth 10 may be in particulate form such as small fragments or compacted briquettes of the material to be refined and cast into an ingot.

Two directionally controllable energy input devices 14 and 15, such as conventional electron beam guns or plasma torches, are mounted above the hearth 10 and arranged to direct energy toward the hearth in controllable patterns, 16 and 17, respectively, in response to signals from a control unit 18. If the energy input devices 14 and 15 are electron beam guns the mold and hearth are enclosed in a vacuum housing in the usual manner. The inner end 19 of the bar 13 of metal to be refined is melted in the usual manner by energy received from the energy input device 14, producing a stream 20 of molten material flowing into the hearth 10 to provide a pool 21 of molten material. Because the hearth bed 11 is cooled by liquid flowing through the pipes 12, a solid skull 22 of the molten material forms on the inner surface of the hearth bed protecting it from degradation by the molten metal.

At the opposite end of the hearth 10, a pouring lip 23 is formed by an opening in the hearth wall, permitting a stream 24 of molten material to flow from the hearth into a mold 25 in which the metal is solidified into an ingot 26 as a result of radiant cooling from the surface of the molten metal in the mold as well as the cooling liquid circulated through pipes 27 in the mold. The ingot 26 is withdrawn downwardly from the mold 25 in the direction of the arrow in the usual manner and, in order to assure a uniform grain structure and composition, the ingot should be withdrawn continuously at a substantially uniform rate rather than intermittently.

In order to refine the molten metal in the pool 21 in the hearth 10 in a desired manner, the directed energy input devices 14 and 15 are controlled by the control unit 18 so as to make certain that the molten material in the pool 21 contains no solid particles which might contaminate or cause solid inclusions to be incorporated into the ingot 26 and also to vaporize undesired constituents. In addition, the energy input device 15 is preferably controlled so as to raise the temperature of the molten material in the pool 21 as it approaches the pouring lip 23 to a level appreciably above the liquidus point of the metal such as 30° C. and preferably 50° C. to 100° C. or more above that point, in order to make certain that no solid particles or crystals enter the mold 25. For that purpose, a temperature detector 28 such as a pyrometer is positioned to detect the temperature of the molten metal as it flows toward the pouring lip 23. The detector 28 supplies a signal representing the detected temperature by a line 29 to the control unit 18 for comparison therein with a preset temperature level, and the control unit controls the energy supplied by the device 15 to the molten material in that region of the hearth to achieve the desired temperature level. Alternatively, if desired, the output of the temperature detecting device 28 may be observed visually and the energy supplied by the device 15 may be controlled manually.

For certain applications, such as refining of nickel-base alloys, it may be desirable to provide a skimmer disposed across the end of the hearth adjacent to the pouring lip 23 so as to prevent any floating material from reaching the pouring lip. This will assure that any floating impurities such as oxides which are not removed in the refining process cannot be transferred to the ingot formed in the mold.

The molten material 24 supplied from the pouring lip 23 to the mold 25 forms a pool 30 of molten metal at the top of the mold. The portion adjacent to the inner surface of the mold solidifies more rapidly than the center portion of the pool because of the adjacent cooling pipes 27 in the mold and, in order to supply energy in a desired manner to the molten metal in the pool 30 a directionally controllable energy input device 31 is positioned to direct a pattern of energy 32 toward the surface of the molten metal 30 in the mold.

The energy input device 31, which may be a conventional plasma torch or electron beam gun, is controlled by the control unit 18 to produce a desired pattern of energy input and, in accordance with the invention, to maintain the temperature in the central region 33 of the surface of the pool approximately at or slightly below the liquidus point of the molten metal so that a small number of small crystallites 34 but no significant quantities of solid material appear in that region. At the same time, the temperature of the molten metal surface adjacent to the sides of the mold must be maintained above the liquidus temperature to assure the integrity of the side wall of the ingot. When the temperature in the central region 33 of the surface of the molten metal in the mold 25 is maintained at or slightly below, i.e., from about 0° C. to about 20° C., and preferably from about 0° C. to about 10° C., below the liquidus point of the metal, ingots having fine grain with uniform distribution can be prepared in a controllable manner. For example, the cell structure or secondary dendrite arm spacing of ingots prepared in accordance with the invention may be on the order of about 50 to 150, and preferably 80 to 120 micrometers.

Figure 2:
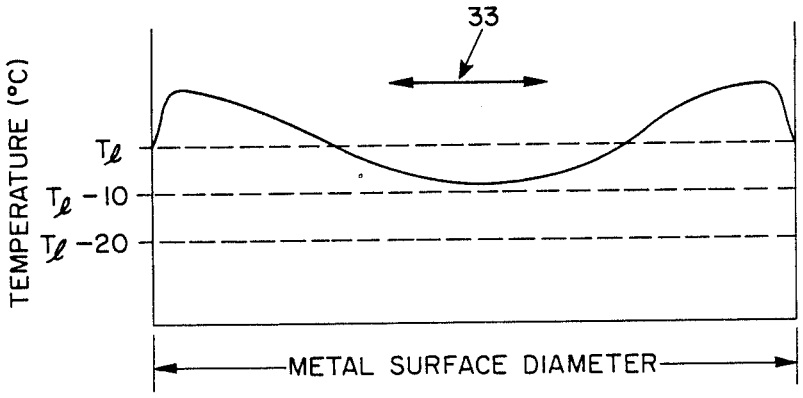
FIG. 2 is a graphical representation showing a typical temperature profile at the upper surface of an ingot being cast in accordance with the invention.

A typical surface temperature profile for the molten metal in the mold is shown in FIG. 2 wherein the liquidus temperature of the metal is designated $T_l$. In this example, the energy input device 31 is controlled to maintain the temperature in the central region 33 about 5° C. to 8° C. below the liquidus point, while the temperature near the periphery of the mold is kept about 10° C. above the liquidus point.

While the reason for the improved ingot obtained in accordance with the present invention is not fully understood, it is believed that the presence of a small number of small crystallites in the central region of the molten material indicates the beginning dendrite growth beneath the surface and the small tips of those dendrites are sheared off and fall to the liquid-solid interface where they provide a fine uniform grain structure. This is in contrast to the effect produced by large quantities of solid material in the molten mixture, such as the 50% solids content described in the above-mentioned U.S. Pat. Nos. 4,583,580 and 4,681,787.

In place of visual observation of the crystallites 34 to detect the necessary temperature condition in the central region of the molten material in the mold, a temperature detecting device 35 may be positioned to detect the temperature of the molten metal in the pool 30, at least in the central region 33, and provide a corresponding signal on a line 36 to the control unit 18. If a scanning pyrometer is used, the temperature in the peripheral region may also be detected and controlled so as to avoid cold shuts without an excessive increase in temperature. To provide the desired fine-grain ingots in accordance with the invention, preferably about 5% to 25% of the energy supplied by the source 31 is directed to the central region 33.

Because the temperature profile of the molten metal in the mold can be controlled in a desired manner in accordance with the invention to produce fine-grain ingots, the mold 25 may be of any desired size and shape and may include multiple molds to provide several ingots simultaneously. Heretofore, because of the radiant cooling of the molten metal in the mold, it was not possible to control the solidification of large-size ingots, or ingots of noncircular cross-section, or of multiple ingots in the same mold, while providing the desired fine-grain ingot structure.

Although the invention has been described herein with reference to specific embodiments, many modifications and variations therein will readily occur to those skilled in the art. Accordingly, all such variations and modification are included within the intended scope of the invention.

We claim:

1. A method for continuous casting of a metal ingot comprising supplying molten metal to the upper portion of a mold, cooling the molten metal in the mold to form a solid ingot which is withdrawn from a lower portion of the mold, and controlling the temperature in the central region of the surface of the molten metal in the mold to maintain it at a level at which the molten metal solidifies to form crystallites without forming larger masses of solid material in the central region of the surface of the molten metal the mold.

2. A method according to claim 1 including the step of supplying energy to the central region of the surface of the molten metal to maintain the temperature of that portion approximately within the range from the liquidus temperature of the metal to 20° C. below the liquidus temperature of the metal.

3. A method according to claim 2 including the step of controlling the energy supplied to the central region to maintain the temperature in that region approximately within the range from the liquidus temperature of the metal to 10° C. below the liquidus temperature of the metal.

4. A method according to claim 1 including the steps of supplying molten metal from a hearth to the mold and maintaining the temperature of the molten metal in the portion of the hearth from which it is supplied to the mold at least 30° C. above the liquidus temperature of the metal.

5. A method according to claim 4 including the step of maintaining the temperature of the molten metal in the region of the hearth from which it is supplied to the mold in a range from about 50° C. to about 100° C. above the liquidus temperature of the metal.

6. A method according to claim 4 including the step of detecting by pyrometry the temperature of the molten metal in the portion of the hearth from which the metal is supplied to the mold.

7. A method according claim 6 including the step of automatically controlling the supply of energy to the molten metal in the portion of the hearth from which molten metal is supplied to the mold in response to a signal representing the temperature detected by pyrometry.

8. A method according to claim 1 including the step of detecting the temperature in the central region of the surface of the molten metal in the mold by pyrometry.

9. A method according to claim 8 including the step of supplying energy to the central region of the surface of the molten metal in the mold in accordance with a signal representing the temperature detected by pyrometry.

10. A method according to claim 1 including the step of withdrawing the ingot from the mold continuously at a substantially uniform rate.

11. A method according to claim 1 including the step of supplying metal to the hearth by melting the end of a bar of metal which is moved toward the hearth.

12. A method according to claim 1 including the step of supplying metal to the hearth by introducing particulate metallic material into the hearth.

13. Apparatus for continuous casting of metal ingots comprising a mold adapted to receive molten metal in an upper portion thereof, cooling means for solidifying the molten metal to produce a solid ingot which is withdrawn from a lower portion of the mold, energy input means for applying energy in a controlled manner to the molten metal in the mold, temperature detecting means for detecting the temperature in the central region of the surface of the molten metal in the mold, and control means for controlling the energy input means to maintain the temperature of the surface of the molten metal in the central region of the mold at a desired level.

14. Apparatus according to claim 13 wherein the energy input means comprises electron beam gun means.

15. Apparatus according to claim 13 wherein the energy input means comprises plasma torch means.

16. Apparatus according to claim 13 wherein the control means controls the energy input detecting means in accordance with a signal from the temperature detecting means.

17. Apparatus according to claim 16 wherein the control means controls the energy input means so as to maintain the temperature of the surface of the molten metal in the central region of the mold in the range from about 0° C. to 20° C. below the liquidus temperature of the metal.

18. Apparatus according to claim 16 wherein the control means controls the energy input means so as to maintain the temperature of the surface of the molten metal in the central region of the mold in the range from about 0° C. to 10° C. below the liquidus temperature of the metal.

19. Apparatus according to claim 13 wherein the temperature detecting means comprises pyrometer means.

20. Apparatus according to claim 19 wherein the pyrometer means comprises scanning pyrometer means for producing a representation of the temperature profile of the surface of the molten metal in the mold.

21. Apparatus according to claim 13 including hearth means for containing molten metal to be supplied to the mold, hearth energy input means for melting metal supplied to the hearth means and maintaining the metal therein in a molten condition, and transfer means for transferring molten metal in a molten condition from the hearth means to the mold means.

22. Apparatus according to claim 21 including hearth temperature detecting means for detecting the temperature of the molten metal in the region of the hearth means from which it is supplied to the mold means.

23. Apparatus according to claim 22 wherein the control means includes means for controlling the hearth energy input means in response to signals from the hearth temperature detecting means to maintain the temperature of the molten metal in the region from which it is supplied to the mold means at a selected level above the liquidus temperature of the metal.

24. Apparatus according to claim 23 wherein the control means controls the hearth energy input means to maintain the temperature of the molten material in the region of the hearth from which it is supplied to the mold means at a temperature at least 30° C. above the liquidus temperature of the metal.

25. Apparatus according to claim 24 wherein the control means controls the hearth energy input means to maintain the temperature of the molten material in the region of the hearth from which it is supplied to the mold means at a temperature between about 50° C. and about 100° C. above the liquidus temperature of the metal.

* * * * *

UNITED STATES PATENT AND TRADEMARK OFFICE

CERTIFICATE OF CORRECTION

PATENT NO. : 4,838,340

DATED : June 13, 1989

INVENTOR(S) : Charles H. Entrekin et al.

It is certified that error appears in the above-identified patent and that said Letters Patent is hereby corrected as shown below:

Column 1, line 36: The word "utilized" should read --utilizes--.

Column 6, line 20: After "metal" insert --in--; line 49: After "according" insert --to--.

Column 7, line 24: After "input" delete "detecting".

Signed and Sealed this

Twenty-fourth Day of April, 1990

*Attest:*

HARRY F. MANBECK, JR.

*Attesting Officer*

*Commissioner of Patents and Trademarks*